US005190377A

United States Patent [19]

Kelly

[11] Patent Number: 5,190,377

[45] Date of Patent: Mar. 2, 1993

[54] BINGO PURSE

[76] Inventor: Mary T. Kelly, 9282 Burnt Store Rd., Punta Gorda, Fla. 33950

[21] Appl. No.: 877,764

[22] Filed: May 4, 1992

[51] Int. Cl.[5] ..... B65D 33/02

[52] U.S. Cl. ..... 383/29; 383/37; 383/39; 383/75; 383/96; 150/112

[58] Field of Search ..... 383/29, 37, 38, 39, 383/40, 72, 75, 97, 96; 150/111, 112, 117; 206/372, 373, 579

[56] References Cited

U.S. PATENT DOCUMENTS

| | | | |
|---|---|---|---|
| 1,681,922 | 8/1928 | Boch | 383/39 |
| 2,177,906 | 10/1939 | Miller | 383/38 X |
| 2,533,850 | 12/1950 | Syracuse | 383/38 X |
| 2,697,465 | 12/1954 | Johnson | 383/39 X |
| 3,587,698 | 6/1971 | Ritter | 150/112 X |
| 3,955,609 | 5/1976 | Siegel | 150/112 X |
| 4,646,804 | 3/1987 | Damiano | 383/38 X |
| 4,977,941 | 12/1990 | Henderson | 383/39 X |
| 5,009,516 | 4/1991 | Geeck | 383/37 |

FOREIGN PATENT DOCUMENTS

| | | | |
|---|---|---|---|
| 512191 | 1/1954 | Belgium | 383/75 |
| 447233 | 12/1912 | France | 383/75 |

*Primary Examiner*—Allan N. Shoap
*Assistant Examiner*—Jes F. Pascua
*Attorney, Agent, or Firm*—Frank A. Lukasik

[57] ABSTRACT

A carrying case for carrying and storage of Bingo playing equipment such as Bingo chips, pencil markers, wands, paper and the like, said case comprising a lightweight, fabric, vinyl, or leather including a zippered opening and a series of pockets formed by stitching pieces of material to the exterior of the bag. A smaller drawstring bag is included and may be used to retain chips or other items.

7 Claims, 2 Drawing Sheets

BINGO PURSE

BACKGROUND OF THE INVENTION

1. Field of the Invention

This invention relates generally to carrying cases and more particularly to a novel carrying case specifically adapted to keep bingo-playing accessories organized and easily accessible.

2. Discussion of the Prior Art

The game of Bingo has always been popular and is now of an ever increasing popularity as an enjoyable past time with Bingo games being held by many establishments such as churches, clubs and the like. In addition, high stake games, played on Indian Reservations, are becoming widespread. As the stakes increase, players purchase more cards to increase the odds of winning. In order to play more cards, players must be organized in an efficient manner. For an individual to be able to attend such Bingo playing sessions, it is necessary that the individual be prepared with those items conventionally needed to play Bingo, such as card covering chips, pencils, markers, chip aprons, and in some cases, other devices such as magnetic wands for picking up chips.

The Bingo player carries accessories in addition to the chips, the wand, and the Bingo markers. A pad of blank paper is useful to record information such as the "lucky number." If the player wins Bingo on a lucky number, the player will win a big prize, and it is important for the player to write the number down so that it can be remembered. A pencil should be carried for writing the number. In addition, players may also carry glasses, wallets, cigarettes, and other items. The need for all of these accessories requires organization.

There are numerous handbags for playing Bingo. One type of handbag which has had varying degrees of acceptance is commonly referred to as a "drawstring" handbag. This handbag is generally tubular in configuration, having drawstrings about its uppermost circumference. Pulling upon the drawstring loops gathers the material about the top of the handbag, thereby closing the top opening. One such handbag is disclosed in U.S. Pat. No. 4,977,941 to Henderson wherein a Bingo bag is formed by quilt material sewed into a hollow container that is open at its upper end. Fabric is stitched to the inner surface of the container to form a plurality of pockets. The quilt material is stiff enough that the bag sits in an upright position to make the Bingo playing accessories accessible. Another drawstring handbag is shown in U.S. Pat. No. 4,646,804 to Damiano which discloses a series of pockets having top openings which are less than or equal to 3/5 of the distance from the bottom to the top of the bag. A cup is secured to the base of the bag for holding Bingo chips and the like.

Another type of Bingo bag is shown in U.S. Pat. No. 3,871,519 to Groomes which discloses a case comprised of two separate mating circular half portions being hinged to a base at one end and having cooperating mating handles at the opposite end. The interior of the case is sectionalized to hold the various Bingo components.

SUMMARY OF THE INVENTION

The present invention recognizes the enjoyment of Bingo and the problems associated with the play thereof as to the transporting of the various items needed in such play. The present invention provides a novel solution thereto in the form of a lightweight, fabric, vinyl, or leather carrying case designed for carrying the various implements used by Bingo players such as marking pencils, magnetic markers, plastic chips wands, etc. The compact carrying case includes a zippered opening and a series of pockets formed by stitching pieces of material to the exterior of the bag. The handbag of this invention provides a remarkably versatile holder for Bingo items. The pens, markers, and wands are easily placed within the pockets formed on the bag and the marking instruments are clearly displayed. A larger pocket may hold a spectacle or cigarette case. A smaller drawstring bag is included and may be used to retain chips or other items.

Accordingly, it is an object of the invention to provide a new and improved handbag which is capable of holding the various items needed to play Bingo in an organized manner.

It is another object of the invention to provide a handbag for carrying Bingo items which is inexpensive to manufacture and easy to use.

Another object of the invention is to provide a handbag for carrying items needed to play Bingo in an organized, convenient, and accessible way.

It is still another object of the invention to provide a zippered handbag which can be easily opened by persons with little strength in their fingers.

Other objects and advantages of the invention are set forth in part herein and in part will be obvious herefrom, or may be learned by using the invention, the same being realized and attained by means of the instrumentalities and combinations pointed out in the appended claims. This invention consists of the novel parts, constructions, arrangements, combinations and improvements herein shown and described.

DESCRIPTION OF THE PREFERRED EMBODIMENT

Figure 4:
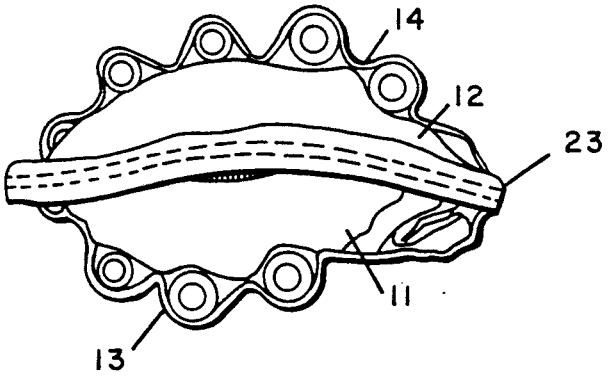
FIG. 4 is an elevational view of a top side of the invention.
Figure 1:
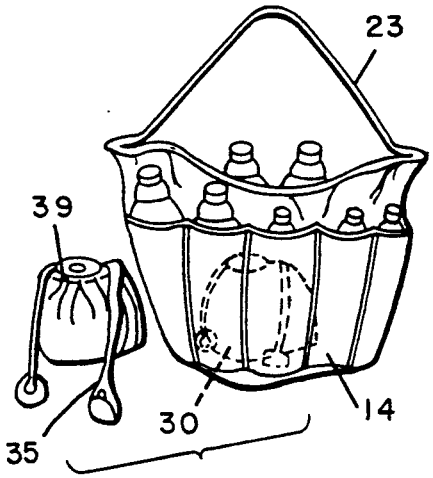
FIG. 1 is an elevational view of a first side of the invention.
Figure 2:
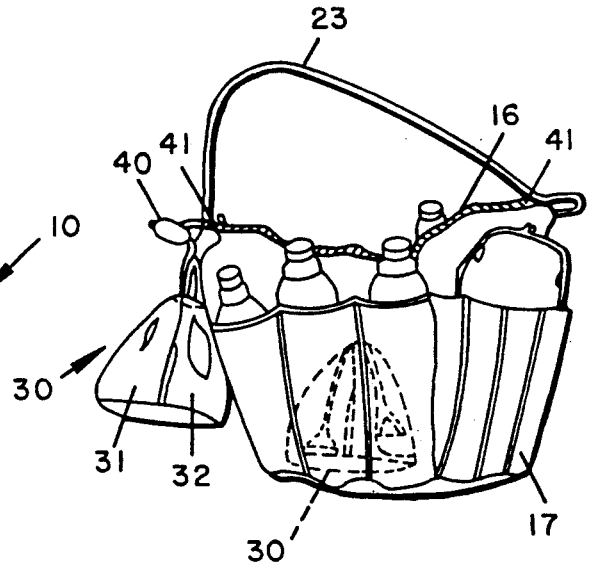
FIG. 2 is an elevational view of a second side of the invention.
Figure 3:
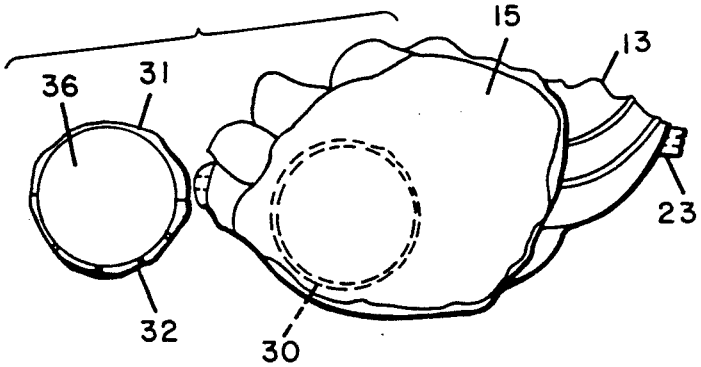
FIG. 3 is an elevational view of the bottom side of the invention.
Figure 6:
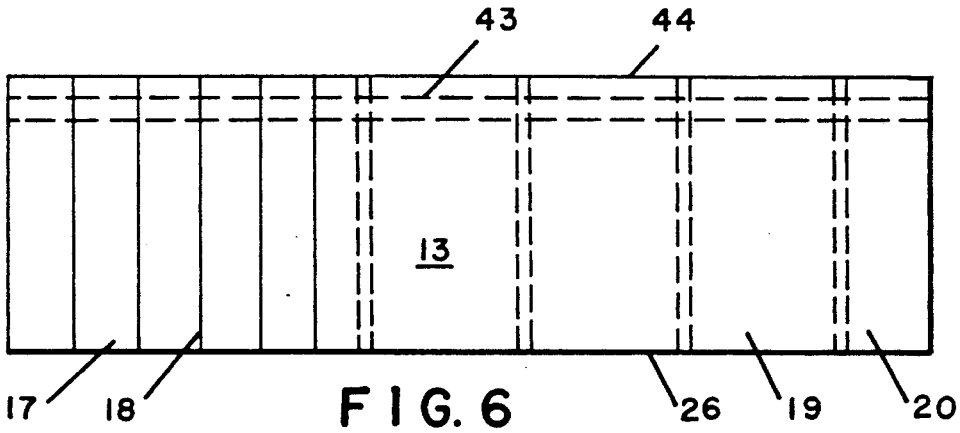
FIG. 6 is a front view of a cutout for panel side A.
Figure 7:
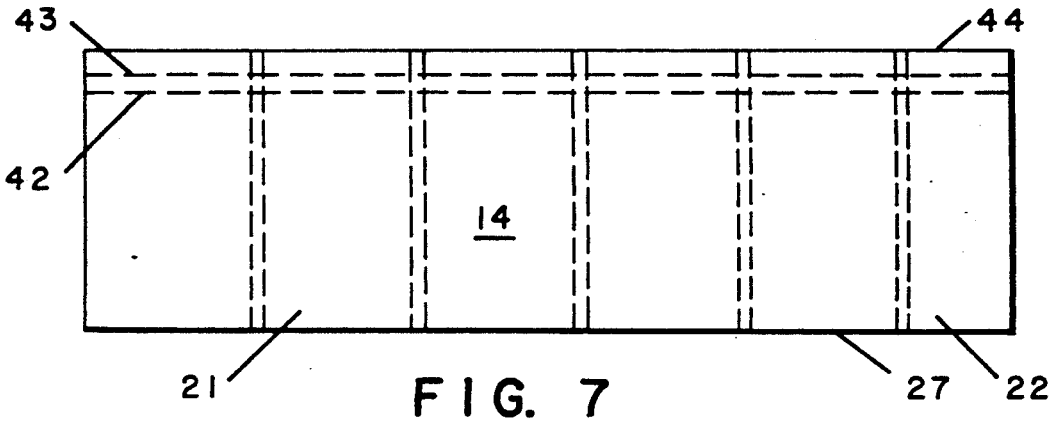
FIG. 7 is a front view of a cutout for panel side B.
Figure 8:
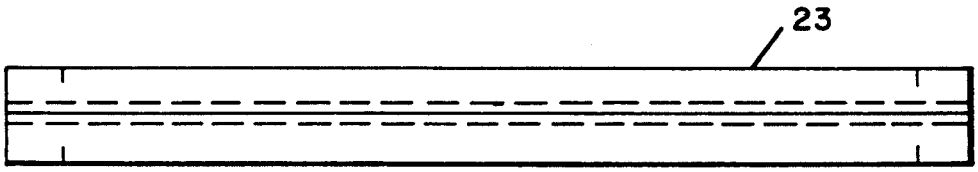
FIG. 8 is a bottom view of a handle for the handbag of the invention.
Figure 9:
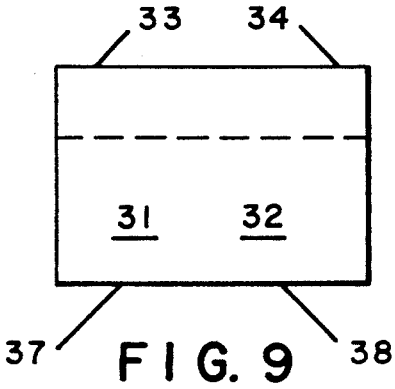
FIG. 9 is a front view of a cutout for the two sides of the interior pouch of the invention.
Figure 5:
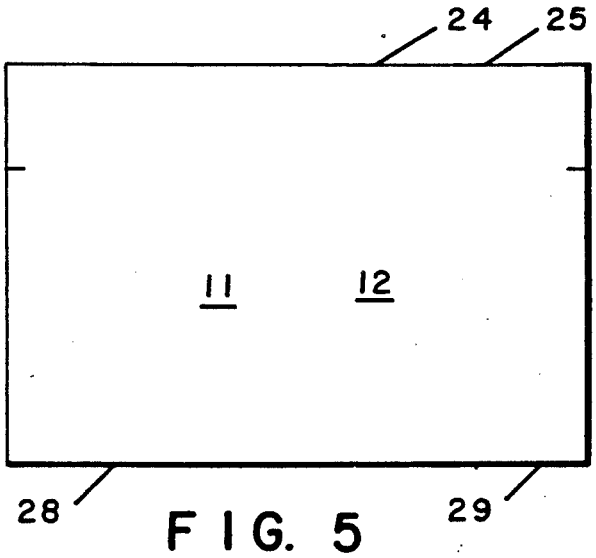
FIG. 5 is a front view of a cutout for the two sides of the invention.

Referring now to the drawings in detail there is illustrated a preferred form of a Bingo handbag constructed in accordance with the principles of the present invention and designated generally in its entirety by the reference numeral 10. Handbag 10 comprises generally, sides 11, and 12, panels 13, and 14, and circular base member bottom 15. In a preferred embodiment, the handbag 10 was constructed with a 15" white poly zipper and tab 16, and a 9" circle cut for bottom 15 of bag 10. Panels 13 and 14 were each fabricated as a 23"×7" panel with a 1" hem 42 along the top end 43 of the lengthwise edge 44. Handbag 10, sides 11 and 12 were each fabricated as a 14½"×10" panel with a ¾" hem for the zipper 16 at the top end 43.

Panel 13 contains one large 8½" pocket 17 with 5 double sewn tucks 18, three medium (3½") pockets 19, and one pen/pencil (2½") pocket 20. Panel 13 contains a 1" hem 42 sewn lengthwise, tucks are then sewn top end 43 to bottom end 26. Panel 13 is then joined to side 11, the narrow hem last 3" to the top end 43. Pockets 19, 20, 21, and 22 are double sewn on panel 13. Panel 14 contains a 1" hem 42 sewn lengthwise, tucks sewn top end 43 to bottom end 27. Panel 14 contains five 4" pockets 21, and one 3" pocket 22. Panel 14 is then joined to side 12, the narrow hem last 3" to the top end 43.

Zipper 16 is attached to bag handle 23 one inch on either end to stopper 41. Handle 23 is double stitched with the sides folded over to center lengthwise (turned over on itself, double side with no unfinished surface). Bag side tops 24 and 25 are sewn to zipper 16 from the entire 15" length including one inch of the handle 23 on either end. Handle 23 is folded 1½" over zipper 16 and double stitched to form a stopper 41 on each edge of zipper 16.

The panel bottoms 26 and 27 are tucked and sewn to side bottoms 28 and 29. A nine inch circular bottom 15 is then sewn to side bottoms 28 and 29 to form the completed handbag 10.

The next step is to assemble the pouch. Side panels 31 and 32 may be cut to 7⅜"×5½" with a 2" hem at the tops 33 and 34 to provide a channel for a drawstring 35. Side panels 31 and 32 are joined together at the ends with the last 2" of tops 33 and 34 narrow hemmed. A five inch circular pouch bottom 36 is then sewn to bottoms 37 and 38 of sides 31 and 32. Pouch 30 is then turned to right side and the top is folded down and stitched double to form the casing 39. Drawstrings, about 21" are threaded through the casing 39 and wooden beads 40 are attached and knotted.

The material used for the handbag 10 and pouch 30 is preferably vinyl, NAUGAHYDE, a registered trademark for a fiber or fabric backed vinyl, fabric, mesh type vinyl or leather. The fabric is preferably sewn with upholstery weight monofilament thread. The drawstring 35 may be macrame weight or light nylon cord. The beads 40 may be wooden.

In use, the player sits at the Bingo table and sets the Bingo bag 10 on the table. The accessories are exposed and readily available. Those that are needed for the particular game are pulled out. The items can be returned from time to time if they are not in use in order to eliminate clutter from the Bingo table.

While the invention has been explained with respect to a preferred embodiment thereof, it is contemplated that various changes may be made in the invention without departing from the spirit and scope thereof.

What is claimed is:

1. A Bingo carrying case adapted for carrying of the various items required for use in the play of the game of Bingo, the carrying case comprising:

first and second sides secured together to form a circular tube, said first and second sides each having a top end and a bottom end, first and second panels secured to said first and second sides and to said bottom ends of said first and second sides, said first and second panels having a series of pockets formed between the surfaces of said sides and panels, a circular bottom member secured to said bottom ends of said first and second sides and said first and second panels, thereby forming a container, a zipper secured to said top ends of said first and second sides, for closing said top ends, and a handle secured to said top end of said first and second sides and to opposite ends of said zipper, thereby forming a carrying handle and a stopper for each end of said zipper.

2. The Bingo carrying case as described in claim 1, including a drawstring bag within said Bingo carrying case or attached to said carrying case, said bag comprising two sides, each side having top and bottom ends, said top ends having a channel sewed thereon, a circular bottom member secured to said bottom ends of said sides thereby forming a container, and a drawstring having a first and a second end, strung through said channel said drawstring having wooden beads strung on each end thereof and knotted at each end for retaining said beads.

3. The Bingo carrying case as described in claim 1 comprising fabric backed vinyl material.

4. The Bingo carrying case as described in claim 1 wherein said handle is double stitched with sides folded over to center lengthwise, and said handle being folded 1½" over said zipper and double stitched.

5. The Bingo bag carrying case as described in claim 1 wherein said panels have a 1" hem sewn lengthwise, tucks sewn top to bottom, and said pockets are double sewn on said panels.

6. A Bingo carrying case adapted for carrying of the various items required for use in the play of the game of Bingo, the carrying case comprising:

first and second sides stitched together to form a circular tube, said first and second sides each having a top end and a bottom end, each of said top ends having a hem, first and second panels stitched to said first and second sides and to said bottom ends of said first and second sides, each of said panels having a hem sewn lengthwise, tucks sewn top to bottom and forming a series of varying sized pockets between the surfaces of said sides and said panels, a circular bottom member secured to said bottom ends of said first and second sides and said first and second panels, thereby forming a container, a zipper secured to said top ends of said first and second sides, for closing said top ends, and a handle secured to said top end of said first and second sides and to opposite ends of said zipper, thereby forming a carrying handle and a stopper for each end of said zipper, said handle being double stitched with sides folded over to center lengthwise, and said handle being folded over said zipper and double stitched.

7. The Bingo carrying case as described in claim 6, including a drawstring bag within said Bingo carrying case or attached to said carrying case, said bag comprising two sides, each side having top and bottom ends, said top ends having a channel sewed thereon, a circular base member secured to said bottom ends of said sides thereby forming a container, and having a drawstring having a first and a second end, strung through said channel, said drawstring having wooden beads strung on each end thereof and knotted at each end for retaining said beads.

* * * * *